US006877587B2

(12) United States Patent
Kunz et al.

(10) Patent No.: US 6,877,587 B2
(45) Date of Patent: Apr. 12, 2005

(54) EQUIPMENT FOR DETERMINING ELEVATOR CAR POSITION

(75) Inventors: René Kunz, Luzerne (CH); Eric Birrer, Luzerne (CH); Matthias Lorenz, Luzerne (CH)

(73) Assignee: Inventio AG, Hergiswil (CH)

( * ) Notice: Subject to any disclaimer, the term of this patent is extended or adjusted under 35 U.S.C. 154(b) by 0 days.

(21) Appl. No.: 10/767,939

(22) Filed: Jan. 29, 2004

(65) Prior Publication Data

US 2004/0216962 A1 Nov. 4, 2004

Related U.S. Application Data

(63) Continuation of application No. PCT/CH02/00405, filed on Jul. 22, 2002.

(30) Foreign Application Priority Data

Jul. 31, 2001 (EP) ..... 01810749

(51) Int. Cl.[7] ..... B66B 3/00
(52) U.S. Cl. ..... 187/394; 187/408
(58) Field of Search ..... 187/394, 406, 187/291, 318, 400, 284, 408, 409

(56) References Cited

U.S. PATENT DOCUMENTS 2,498,299 A * 2/1950 Rissler ..... 187/406
3,425,516 A * 2/1969 Maruyama et al. ..... 187/409
3,554,327 A * 1/1971 Takamura et al. ..... 187/409
3,856,116 A * 12/1974 Savage ..... 187/276
5,023,434 A 6/1991 Lanfer et al.
5,135,081 A * 8/1992 Watt et al. ..... 187/394
5,360,085 A * 11/1994 Yoo et al. ..... 187/406
5,594,219 A * 1/1997 Kamani et al. ..... 187/394
5,925,859 A * 7/1999 Miller et al. ..... 187/394
5,931,264 A * 8/1999 Gillingham et al. ..... 187/406
6,128,116 A * 10/2000 Dobler et al. ..... 398/106
6,206,143 B1 * 3/2001 Kammura ..... 187/400

FOREIGN PATENT DOCUMENTS

DE 92 10 996.9 10/1992
EP 0 950 596 10/1999
JP 52041336 A * 3/1977 ..... B66B/1/34

* cited by examiner

*Primary Examiner*—Jonathan Salata
(74) *Attorney, Agent, or Firm*—Butzel Long

(57) ABSTRACT

Equipment for determining a position of an elevator car movable along a guide flange of a guide rail in an elevator installation with a code carrier extending in a travel direction along a length of the guide rail in a groove includes a mount attached to the elevator car, a code reading sensor system attached to the mount, and a plurality of guide rollers rotatably attached to the mount and rolling on the guide flange to maintain the code reading sensor system at a predetermined spacing from the code carrier along two axes.

17 Claims, 3 Drawing Sheets

EQUIPMENT FOR DETERMINING ELEVATOR CAR POSITION

Continuation of prior Application No. PCT/CH02/00405 filed on Jul. 22, 2002.

BACKGROUND OF THE INVENTION

The present invention relates to an elevator installation with equipment for ascertaining the position of an elevator car movable along a guide flange of at least one guide rail.

In elevators, the position ascertaining equipment is used for the purpose of determining the position of an elevator car in the elevator shaft and deriving therefrom data signals for the elevator control. The positional information is applied in coded form fixedly along the entire travel path of the elevator car and is read off in coded form by means of a code reading device and passed on to an evaluating unit. The evaluating device prepares the read-off, coded positional information to be understandable by the control and derives therefrom information signals, so-termed shaft data, which are passed on for controlling the elevator.

Such equipment is shown in the German Utility Model G 92 10 996.9. There the coded positional statements are fixedly applied in the form of a magnetic strip in the movement direction of the elevator car and over the entire travel height thereof. A sensor head fastened to the elevator car and movable in common therewith relative to the magnetic strip in the reading direction of the coding reads off the coded data and passes on the data on for evaluation.

A vibration-damping decoupling device decouples the magnet head from horizontal movements or vibrations of the elevator car and keeps the magnet head at a constant spacing from the magnetic strip. Details with respect to a constructional embodiment are neither described therein nor illustrated in the drawing.

SUMMARY OF THE INVENTION

The present invention therefore has an object of providing indicating equipment, as stated above, for ascertaining the position of an elevator car, which equipment is constructed to be small and reliably enables accurate reading off of the coded positional data with little effort.

According to the present invention this object is met with equipment that is particularly distinguished by the fact that the code reading sensor system has a roller guide rolling on the guide surface of the guide flange.

The advantages achieved by the equipment according to the present invention consist of a very high running smoothness of the roller guide itself at high travel speeds of the elevator car along the guide rail. In this manner travel noises and vibrations, which are transmitted from the guide to the code reading sensor system and falsify the read-out result, are avoided. The guide rollers roll on the guide surface virtually free of wear. Overall, a contactless reading-off of the coded information with a constant small spacing of the sensor system from the length code mark pattern is possible in an economic manner by the roller guide according to the present invention. On the other hand, the roller guide prevents contact of the code reading device, particularly the sensor system thereof, with the length code mark pattern and damage, which results therefrom, of the two subassemblies.

It is advantageous if the roller guide has, in a guide direction, two rollers arranged one behind the other in the travel direction. In this manner the code reading sensor system is guided in dependence on a corresponding length portion of the guide surface, whereby compensation is provided for local unevennesses of the guide surface and the guide path of the code reading sensor system is thus made even.

If in that case the code reading sensor system finds space, in the travel direction, between the guide rollers, this sensor system is guided parallel to the length code pattern. In the case of a code reading sensor system with several sensors arranged one behind the other in the travel direction on a line, these sensors all deliver an output signal of the same strength, which facilitates evaluation.

The roller guide can be matched to the respectively employed type of sensor in a simple manner if the spacing between the sensor system and the length code mark pattern is adjustable within a range of approximately "0 mm<x<5 mm".

The spacing between the sensor system and the guide rail is guaranteed independently of the type of sensors employed and independently of the roller guide if the code reading device has in the first direction an X-abutment which ensures a minimum spacing between the sensor system and the guide surface. A mechanical damage of the sensors is thus excluded even in the case of breakage or wear of the roller guide.

With a two-dimensional roller guide, in which the code reading sensor system is guided along the machined guide surface in a first direction and in a second direction normal to the first direction perpendicularly to the travel direction, the code reading sensor system always remains congruent with the length code mark pattern. This prevents angle deviations relative to the length code mark pattern in the case of a code reading sensor system with several sensors arranged in a line, and read-out errors connected therewith are avoided.

In addition, in the case of such an embodiment a maximum spacing of the sensor system from the end face surface of the guide flange is ensured in that the code reading sensor system has a Y-abutment in the second direction.

Insofar as the mount has a suspension by means of which the code reading sensor system is mounted to be displaceable within a range in a first direction normal to the guide surface and in a second direction normal to the first direction, the roller-guided code reading sensor system is in a position of providing compensation for relative movements and vibrations relative to the elevator car in a horizontal plane. In that case it is advantageous to design the code reading sensor system to be displaceable over a range which is larger than the guide play between the guide shoe of the elevator car and the guide flange.

In a preferred embodiment of the present invention there is present a device for exerting a biasing force which biases the code reading sensor system in a direction towards the guide rail. In this manner the roller guide remains in constant contact with the guide surface independently of horizontal movements of the car.

In such an embodiment a first compression spring is coaxially pushed onto a first axle and a second compression spring onto a second axle, wherein the springs are stressed between a cross-guide member and the mounting of a mount or the mounting of the code reading device and bias the cross-guide member in the direction towards the guide rail.

An embodiment of the present invention in which two suspensions are mounted in the mount in a line parallel to the track of the code mark pattern is particularly advantageous. The first axles and the second axles are mounted to be parallel to one another and the spacing between the two first axles is greater than the spacing of the guide rollers in the travel direction.

Moreover, it is advantageous to arrange the two first axles so that the projection in the travel direction lies within the cross-sectional area of the code reading device. In this manner, a small constructional dimension of the code reading device laterally of the elevator car is achieved for a reduced spacing of the guide rails relative to one another. This manifests itself in an improved utilization of space of the elevator installation. At the same time, a large guide roller spacing guides the code reading sensor system parallel to the length code mark pattern.

The advantages of a construction in which two rollers are additionally arranged at a second spacing one behind the other in the second guide direction, wherein the second spacing is smaller than the first spacing, consist of a compact mode of construction with a parallel guidance, which is exact in a plane normal to the travel direction, with respect to the code mark pattern.

A further increase in running smoothness can be achieved in that each guide roller comprises a wheel rim and a casing of rubber or synthetic material arranged at the circumference thereof. A vibration-damping roller pairing with negligible wear on the machined guide surface is obtainable in accordance with the respective selection of the material of the casing.

If the length code mark pattern is formed at the guide flange, the guide surface and the length coding which is to be read off are disposed at the same component, which facilitates precise guidance of the code reading device with respect to the length code mark pattern.

In that case a placement of the length code mark pattern laterally at the guide flange of the car guide rail by contrast to an arrangement at the end face surface of the guide flange enables a space-saving mode of construction of the code reading device laterally offset adjacent to the guide flange.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
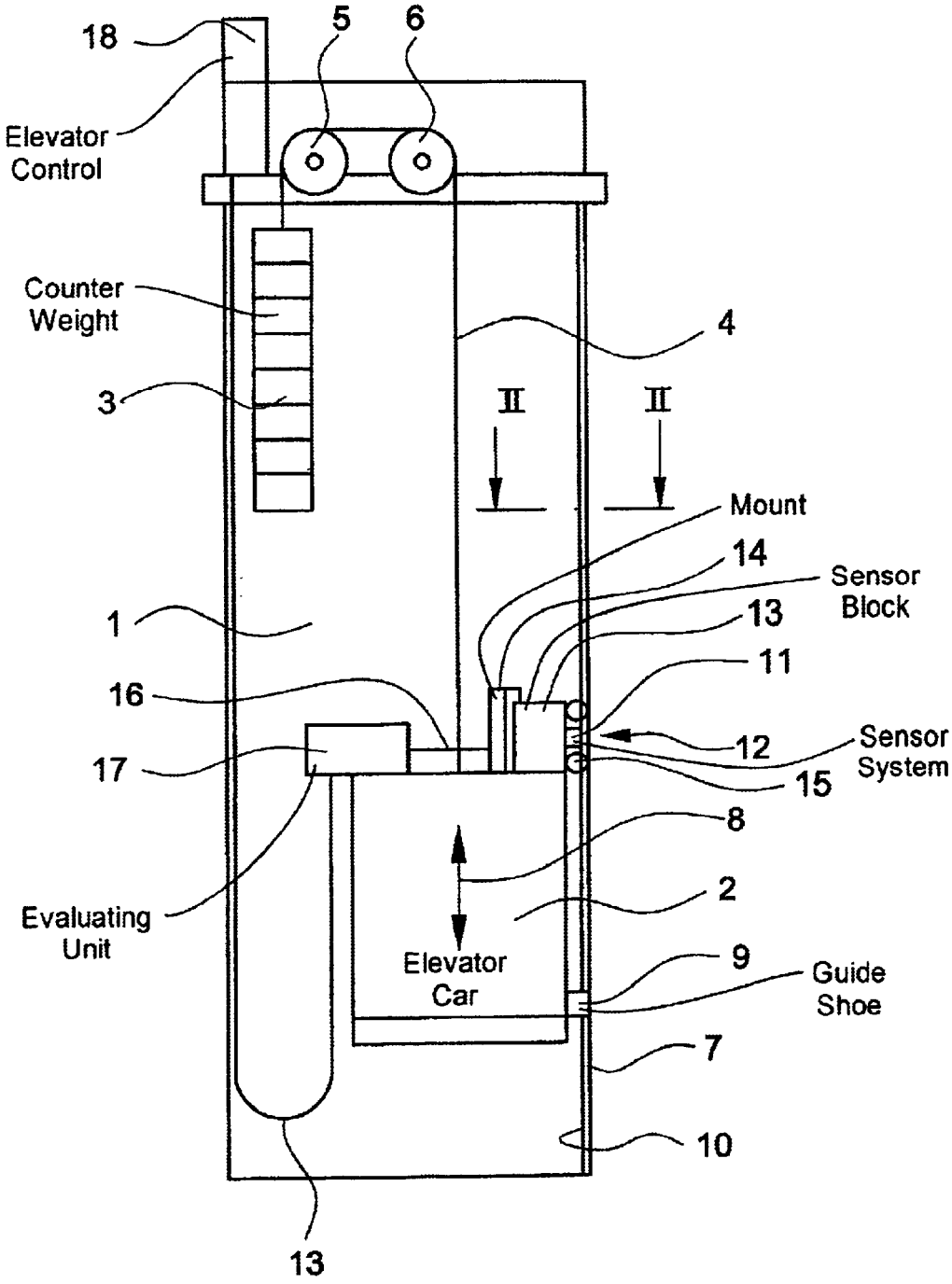
FIG. 1 is a schematic view of an elevator installation with equipment for ascertaining the position of an elevator car according to the present invention.

An elevator installation is schematically shown in FIG. 1 as having a shaft 1, and an elevator car 2 and a counterweight 3 suspended in the shaft at several support cables, which are here illustrated representatively as a single support cable 4. The support cables 4 run over a deflecting roller 5 and are guided by way of a driven drive pulley 6 that transmits the drive forces of a drive motor (not shown) to the support cables 4 for raising and lowering the counterweight 3 and the elevator car 2 along a guide rail 7 in a travel direction 8. Guide shoes 9 fixedly connected with the elevator car 2 serve for guiding the elevator car at the guide rail 7 in a direction normal to the travel direction 8. A code carrier is fixedly applied to the guide rail 7 along the entire travel path of the elevator car 2 parallel to the direction 8 of movement of the elevator car. The code carrier is formed as a magnetic strip 10 and carries in a longitudinal direction a single-track code mark pattern of a plurality of 18-digit pseudo random sequences of "0's" and "1's" formed in a track, so-termed binary code words. Each of these code words represents the numerical code of a signal which reproduces the absolute position of the elevator car 2 in the shaft 1 with respect to a zero point.

The length code mark pattern of the magnetic strip 10 is represented by code marks of different permeability and is read off by means of magnetic-field-sensitive reading stations 27 (FIG. 3) of the code reading sensor system 11. Other physical principles for representation of the length coding are, in principle, also conceivable. Thus, the code marks can also have different dielectric numbers, which are read by sensors detecting capacitive effects. Moreover, a reflective code mark pattern is possible in which in accordance with the respective significance of the individual code marks a greater or lesser amount of light is reflected from an illuminating device to reflected light barriers as sensors.

The coded information of the magnetic strip 10 is contactlessly detected or read off by means of an 18-digit code reading sensor system 11 of a code reading device. Correspondingly, each eighteen bits successively read off the magnetic strip 10 form a binary code word. If the code reading sensor system 11 moves by one bit position of the code mark pattern along the guide rail 7, a new binary code word is read.

The code reading sensor system 11 consists of a first group of eighteen magnetic-field-sensitive reading stations 27 arranged in a line one behind the other and a second group of six sensors which control the first group for reading off the code words. The number of reading stations 27 corresponds with at least the respective digit number of the pseudo random sequences or the length of the code words of the length code mark pattern. There are provided, for example, Hall sensors, inductive transmitters, so-termed GMR sensors or magnetoresistive sensors detecting the magnetic field direction, so-termed MR sensors. Of each of these sensors, several individual ones and/or a group of different sensors combined with one another can be present at a code reading sensor system 11.

The code reading device 12 is fixedly mounted on the elevator car 2 in the travel direction 8. It essentially consists of a sensor block 13, which carries the code reading sensor system 11 and which is mounted by a mount 14 to be displaceable normal to the travel direction 8. A roller guide 15 guides the sensor block 13 at the guide rail 7 when this is moved in common with the elevator car 2 along the magnetic strip 10. The same arrangement is possible also laterally or below at the elevator car 2.

The code reading device 12 transmits the read-off, coded information to an evaluating unit 17 by way of connecting lines 16. The evaluating unit 17 translates the read-off, coded information into an absolute positional statement, which is comprehensible for an elevator control 18, before it is passed on by way of a suspended cable 19 to the elevator control 18, for example for positioning of the elevator car 2.

Figure 2:
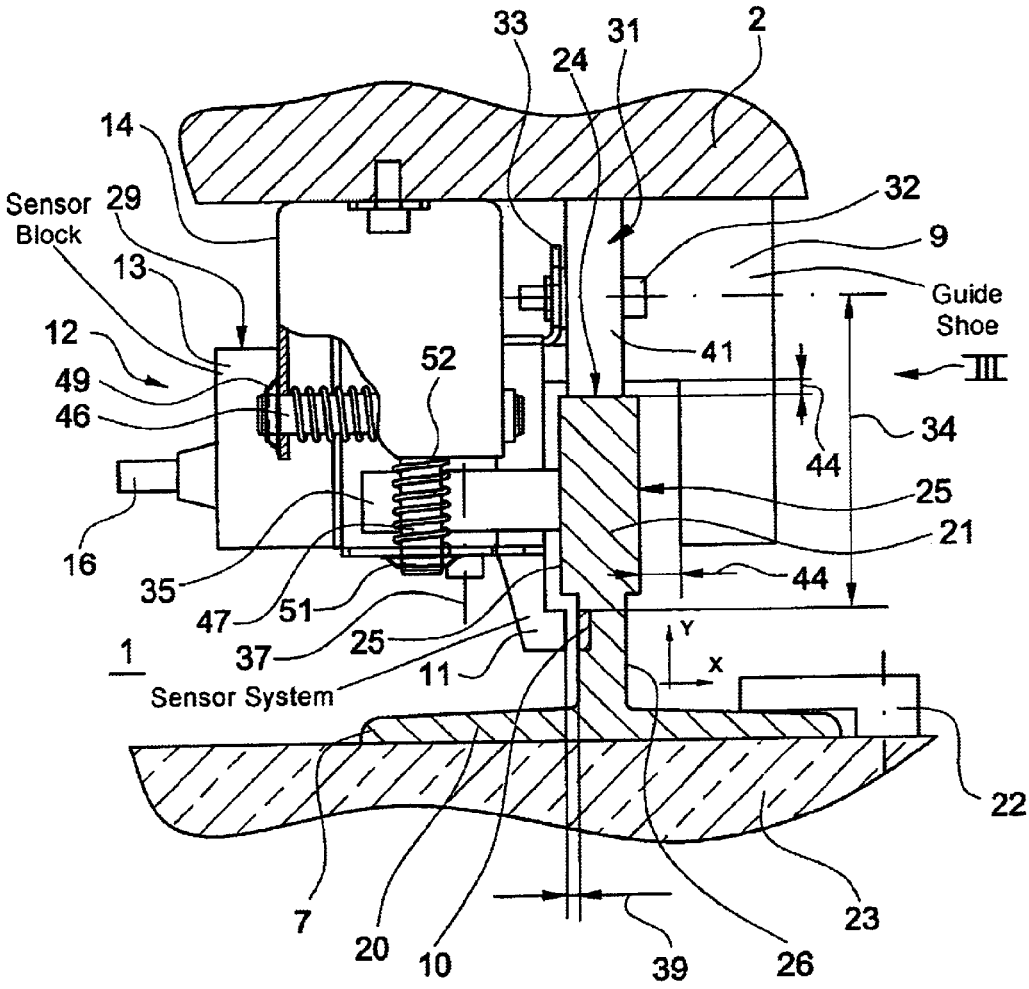
FIG. 2 is an enlarged cross-sectional view along the line II—II in FIG. 1 showing a detail of the equipment.

FIG. 2 shows a detail of a horizontal section of the elevator in the region of the guide rail 7 at the height of the section line II—II in FIG. 1 with a view onto the code reading sensor system 11. Corresponding elements are in that case provided with corresponding reference numerals. The guide rail 7 has a T-shaped cross-sectional profile in which, centrally at a fastening flange 20, a guide flange 21 freely projects to one side at an angle of 90°. The guide rail 7 is clamped in known manner by the fastening flange 20 by means of rail fastenings 22 against a wall 23 of the elevator shaft 1 or another suitable support construction. The guide flange 21 projects in the direction of the elevator car 2 to point into the interior of the shaft 1. An end face guide surface 24 as well as laterally two mutually opposite lateral guide surfaces 25 are formed over the entire length of the guide rail 7 at the free ends of the guide flange 21. In the region of the guide surfaces 24, 25 the guide flange 21 is machined, by metal cutting, within close production tolerances. The guide rail 7 is otherwise unmachined and has a surface corresponding with production by hot rolling.

The free end of the guide flange 21 with the guide surfaces 24, 25 represents together with the one or several guide shoes 9 fastened in stationary position at the elevator car 2 a linear guide for the elevator car. In the embodiment according to FIG. 2 a sliding guide shoe 9 engages in fork-shaped manner, in the plane normal to the travel direction 8, over the free end of the guide flange 21 and guides the elevator car 2 in correspondence with the recorded co-ordinate system along the lateral guide surfaces in the X-direction and along the end face guide surface in the Y-direction in each instance with negligible guidance play 44. Instead of the sliding guide shoe it is also customary to guide the elevator car 2 along the guide flange 21 by means of so-termed roller guide shoes. The rollers of the roller guide shoes are then mounted to be movable perpendicularly to the travel direction 8 and are pressed under bias against the guide surface.

The magnetic strip 10 with the word-coded binary length statement is fixedly mounted laterally at a foot 26 of the guide surface 21. The magnetic strip 10 is inserted into a receiving groove to be flush. In other embodiments the magnetic strip 10 can, however, also be fastened directly on the unmachined guide rails 7.

Figure 3:
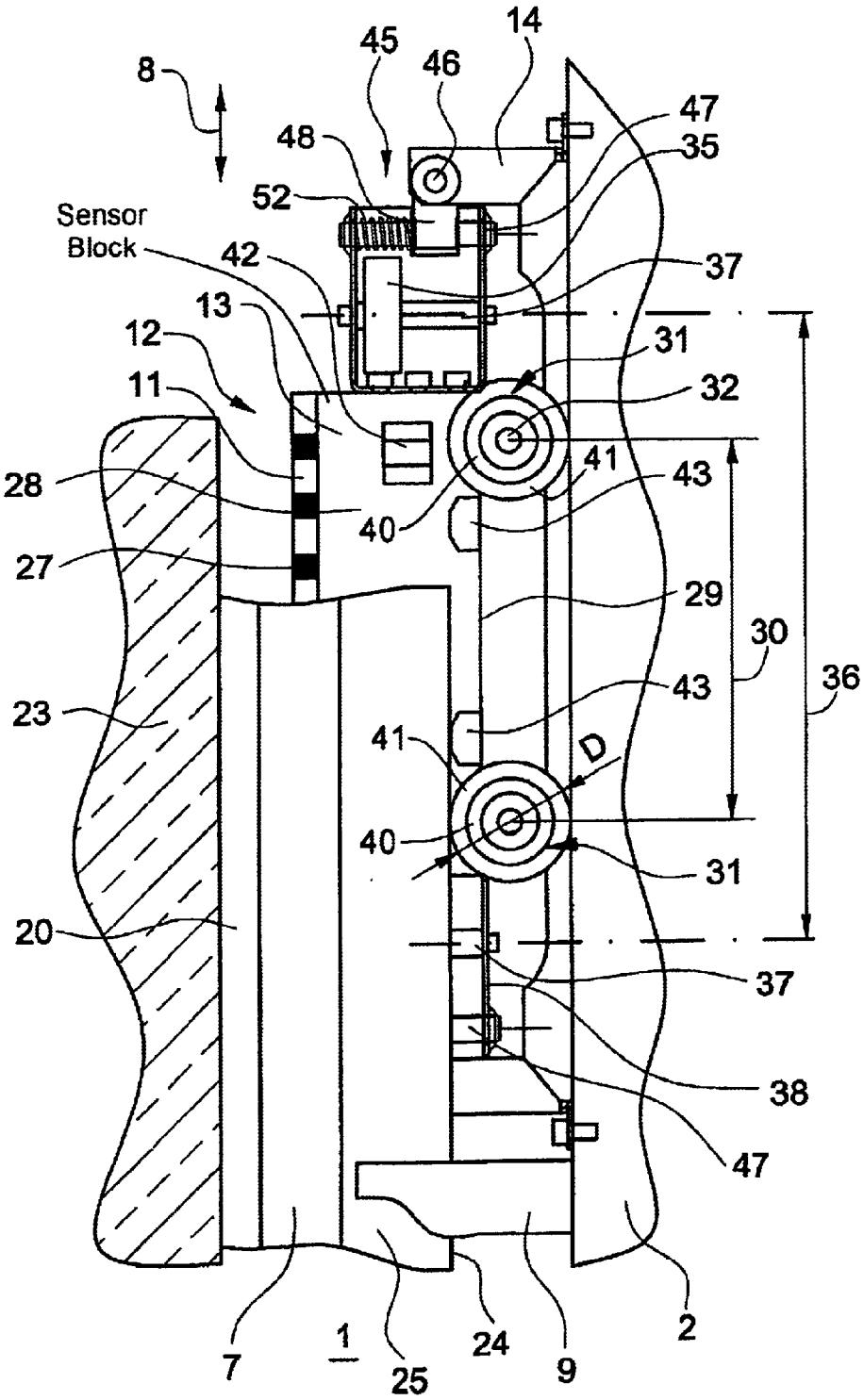
FIG. 3 is an elevation view of the equipment taken in the direction of the arrow III in FIG. 2.

The code reading sensor system 11 is part of the sensor block 13. A detail of the elevator installation of FIG. 1 with the equipment for ascertaining the position of an elevator car is illustrated in FIG. 3 in side view. Corresponding elements are in that case provided with corresponding reference numerals. The block-shaped sensor block 13 is oriented with the longitudinal direction parallel to the travel direction 8 in such a manner that a longitudinal side surface lies parallel to the guide flange 21. At this longitudinal guide surface 28 the code reading sensor system 11 protrudes laterally on the side facing the fastening flange 20. Two guide rollers 31 are mounted on a longitudinal side surface 29, which faces the elevator car 2, at a spacing 30 one behind the other in the travel direction 8 each to be rotatable about a respective axle pin 32 parallel to the end face guide surface 24 and are attached to the sensor block 13 by way of roller mounts 33. The guide rollers 31 roll on the end face guide surface 24. Slots in the roller mounts 33 enable the spacing 34 of the axle pins 32 and the guide rollers 31 relative to the code reading sensor system 11 to be set in the Y-direction. The guide position of the code reading sensor system 11 relative to the end face guide surface is fixed by way of the spacings 30, 34 and the angle alignment of the code reading sensor system 11 is effected in the Y-direction over its entire length exactly congruently with the magnetic strip 10.

Two guide rollers 35 arranged at a spacing 36 one behind the other in the travel direction 8 roll on the lateral guide surface 24. These guide rollers 35 are each rotatable about a respective roller axle 37 which is mounted parallel to the lateral guide surface 25 in a mount 38 of the sensor block 13. The spacing 39 of the code reading sensor system 11 relative to the magnetic strip 21 is settable in a range of "0 mm<x<3 mm" in a direction normal to the lateral guide surface 25 by way of corresponding slots for mounting of the roller axle 37. The code reading sensor system 11 is in principle moved with the smallest possible and most constant possible spacing 39 along the magnetic strip 21 in order to be able to precisely detect the magnetic length coding of the magnetic strip 10 notwithstanding magnetic fields which derive from the code marks and become weaker with increasing spacing. The parallel guidance roller guide 15 of the code reading sensor system 11 in the X-direction with the help of the spaced guide rollers 35 moreover ensures that the reading stations 27, which are arranged one behind the other in the travel direction 8, of the code reading sensor system 11 are all moved at the same spacing 39 relative to the length code mark pattern of the magnetic strip 10 and accordingly the output signal of the reading stations 27 has a constant intensity. An accurate reading-off of the length coding is thereby ensured even at high travel speeds of the elevator car 2.

The guide rollers 31, 35 are in each case wheels with a casing 41 of a rubber or synthetic material, for example polyurethane, coated on a wheel rim 40. Special polyurethane represents a wear-resistant and vibration-damping form of tire, which in addition is economic. In the case of a diameter of about "50 mm", the guide rollers 31, provide compensation for discontinuous transitions in the region of the rail joints. Two X-abutments 42 are formed at the sensor head 11 in the X-direction and two Y-abutments 43 are formed at the sensor head 11 in the Y-direction, the abutments representing a so-termed emergency guidance, for example in the case of failure of a guide roller 31, 35 a minimum spacing between the code reading sensor system 11 and the guide surface 25 and a maximum spacing of the code reading sensor system 11 from the end face end surface 24 of the guide flange 21.

The sensor block 13, which on the one hand in accordance with the present invention is guided by means of the roller guide 15 at the constant spacing 39 in the X-direction and at the spacing 34 in the Y-direction parallel to the magnetic strip 10 at the guide flange 21 of the guide rail 7, is on the other hand mounted by the mounts 38, which are attached at the front and the back in the travel direction 8, in each case by way of a suspension 45 at the mount 14 to be displaceable normal to the travel direction 8.

As shown in FIG. 3, each suspension 45 comprises a second axle 47 mounted in the Y-direction at a mount 38 of the sensor block 13 and a first axle 46 mounted perpendicularly thereto in the mount 14. The two axles 46, 47 are coupled to one another at a right angle by way of a cross-guide member 48. The cross-guide member 48 has for that purpose two passage bores which are at a spacing from one another in the travel direction 8 and the center lines of which intersect at an angle of 90°. The cross-guide member 48 slides within a range axially on the first axle 46 and the second axle 47 and is rotatable in each instance about the corresponding longitudinal axis.

A first compression spring 50 is pushed onto the first axle 46 on the end, which faces away from the guide rail 7, between the cross-guide member 48 and the mounting position 49 of the first axle 46 in the mount 14. The first compression spring 50 exerts on the cross-guide member 48 a biasing force proportional to the displacement path of the cross-guide member 48 and thereby urges the guide rollers 35 in the X-direction against the lateral guide surface 25. Equally, a second compression spring 52 is pushed onto the second axle 47 on the end, which faces away from the elevator car 2, between the cross-guide member 48 and the mounting position 51 of the second axle 47 in the mount 38. The second compression spring 52 exerts on the cross-guide member 48 a biasing force proportional to the displacement path of the cross-guide member 48 and thereby urges the guide rollers 31 in the Y-direction against the end face guide surface 24. The first axles 46 and the second axles 47 of the two suspensions 45 arranged one behind the other in travel direction 8 are respectively parallel to one another. The suspensions 45 thus provide compensation for horizontal movements of the elevator car 2 relative to the sensor block 13 and decouple the code reading sensor system 11 from vibrations of the elevator car 2. A spacing between magnet head and magnetic strip 10 thereby remains constant without impairment.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. Equipment for determining a position of an elevator car movable along a guide flange of at least one guide rail in an elevator installation, the elevator installation including a stationary code carrier extending along a length of the at least one guide rail guide flange in a travel direction of the elevator car, and a code reading sensor system for contactless detection of the length coding of the code carrier, the sensor system comprising:

a mount adapted to be attached to the elevator car, said mount being fixed in the travel direction and movable in a direction normal to the travel direction;

a code reading sensor system attached to said mount;

at least one guide roller rotatably attached to said mount and being adapted to roll on a guide flange of the at least one guide rail to maintain said code reading sensor system at a predetermined spacing from the code carrier; and another guide roller rotatably attached to said mount and arranged behind said at least one guide roller in the travel direction, said another guide roller being adapted to roll on the guide flange of the at least one guide rail to maintain said code reading sensor system at the predetermined spacing from the code carrier.

2. The equipment according to claim 1 wherein said code reading sensor system is disposed, in the travel direction, between said at least one guide roller and said another guide roller.

3. The equipment according to claim 1 wherein each of said at least one guide roller and said another guide roller includes a wheel rim and a casing arranged at a circumference of said wheel rim.

4. The equipment according to claim 1 wherein said predetermined spacing between said code reading sensor system and the code carrier is adjustable in a range of "0 mm<x<3 mm".

5. The equipment according to claim 1 wherein said code reading sensor system has an X-abutment attached thereto adapted to contact the at least one guide rail to maintain a minimum spacing between said code reading sensor system and the guide surface.

6. The equipment according to claim 1 including a means for exerting a biasing force biasing said at least one guide roller towards the guide rail.

7. The equipment according to claim 1 wherein the guide flange is formed with an end face guide surface and at least one lateral guide surface formed at right angles thereto, and wherein said at least one guide roller and said another guide roller are ones of first through fourth guide rollers, said first and second guide rollers being rotatably attached to said mount and being adapted to roll along the lateral guide surface and guide said code reading sensor system in a first direction normal to the lateral guide surface, and said third and fourth guide rollers being rotatably attached to said mount and being adapted to roll along the end face guide surface and guide said code reading sensor system in a second direction normal to the first direction.

8. The equipment according to claim 7 wherein said first and second guide rollers are mounted in a line parallel to the track of the length coding said third and fourth guide rollers are mounted in another line parallel to the length coding.

9. The equipment according to claim 8 wherein a spacing between said first and second guide rollers is greater in the travel direction than a spacing between said third and fourth guide rollers.

10. The equipment according to claim 1 wherein code carrier is retained in a groove formed in the guide flange of the at least one guide rail.

11. Equipment for determining a position of an elevator car movable along a guide flange of at least one guide rail in an elevator installation, the elevator installation including a stationary code carrier extending along a length of the at least one guide rail guide flange in a travel direction of the elevator car, and a code reading sensor system for contactless detection of the length coding of the code carrier, the sensor system comprising:

a mount adapted to be attached to the elevator car, said mount being fixed in the travel direction and movable in a direction normal to the travel direction;

a code reading sensor system attached to said mount;

at least one guide roller rotatably attached to said mount and being adapted to roll on a guide flange of the at least one guide rail to maintain said code reading sensor system at a predetermined spacing from the code carrier; and wherein the guide flange is formed with an end face guide surface and at least one lateral guide surface formed at right angles thereto, said at least one guide roller being adapted to roll along the lateral guide surface and guide said code reading sensor system in a first direction normal to the lateral guide surface and including another guide roller rotatably attached to said mount and being adapted to roll along the end face guide surface and guide said code reading sensor system in a second direction normal to the first direction.

12. The equipment according to claim 11 wherein said code reading sensor system includes a Y-abutment extending in the second direction and adapted to contact the end face guide surface to maintain a maximum spacing between said code reading sensor system and the end face guide surface.

13. The equipment according to claim 11 wherein said mount includes a suspension mounting said code reading sensor system for displacement within a respective range in each of the first direction and the second direction.

14. The equipment according to claim 13 wherein said suspension includes a first axle mounted parallel to the axis of rotation of said at least one guide roller and a second axle mounted normal to said first axle, said first axle and said second axle being coupled by a cross-guide member to each be rotatable about a corresponding longitudinal axis and be axially displaceable within a range at a right angle to one another.

15. The equipment according to claim 14 wherein the elevator car is guided at the guide flange with a guide play by means of at least one guide shoe and that said first axle and said second axle are displaceable within said range which is larger than the guide play.

16. The equipment according to claim 14 including a means for exerting a biasing force biasing said cross-guide member towards the guide rail.

17. Equipment for determining a position of an elevator car movable along a guide in an elevator installation, comprising:

a code carrier extending along a length of the guide rail guide rail in a travel direction of the elevator car;

a mount attached to the elevator car, said mount being fixed in the travel direction and movable in a direction normal to the travel direction;

a code reading sensor system attached to said mount;

at least one guide roller rotatably attached to said mount and rolling on the guide flange of the at least one guide rail to maintain said code reading sensor system at a predetermined spacing from the code carrier;

another guide roller rotatably attached to said mount and rolling on the guide flange of the at least one guide rail to maintain said code reading sensor system at the predetermined spacing from the code carrier.

* * * * *